US007758265B2

(12) United States Patent
Furukawa et al.

(10) Patent No.: US 7,758,265 B2
(45) Date of Patent: Jul. 20, 2010

(54) PRINTING APPARATUS

(75) Inventors: Ryoichi Furukawa, Kokubunji (JP); Katsuyuki Matsuo, Hanno (JP)

(73) Assignee: Casio Computer Co., Ltd., Tokyo (JP)

( * ) Notice: Subject to any disclaimer, the term of this patent is extended or adjusted under 35 U.S.C. 154(b) by 544 days.

(21) Appl. No.: 11/728,291

(22) Filed: Mar. 23, 2007

(65) Prior Publication Data

US 2007/0231045 A1 Oct. 4, 2007

(30) Foreign Application Priority Data

Mar. 30, 2006 (JP) ..... 2006-094928

(51) Int. Cl.
*B41J 29/02* (2006.01)

(52) U.S. Cl. ..... 400/693; 101/35

(58) Field of Classification Search ..... 400/691, 400/692, 693, 120.01, 120.04; 101/35
See application file for complete search history.

(56) References Cited

U.S. PATENT DOCUMENTS 7,252,447 B2 * 8/2007 Kimura et al. ..... 400/621
7,422,297 B2 * 9/2008 Nakamura ..... 347/2
7,513,706 B2 * 4/2009 Kimura et al. ..... 400/693
2006/0078364 A1 * 4/2006 Kimura et al. ..... 400/621

FOREIGN PATENT DOCUMENTS

JP 2000-225746 A 8/2000
JP 2003-072155 A 3/2003
JP 2003-285501 A 10/2003

OTHER PUBLICATIONS

International Search and Written Opinion of the International Searching Authority for PCT/JP2007/ 056764, dated Jul. 13, 2007. 10 Sheets.

* cited by examiner

*Primary Examiner*—Ren Yan
(74) *Attorney, Agent, or Firm*—Frishauf, Holtz, Goodman & Chick, P.C.

(57) ABSTRACT

A printing apparatus has an apparatus body including a platen roller, a thermal head, a storage in which a ribbon cartridge is stored exchangeably through an opening, and a cover of the apparatus body that covers the opening so as to be opened and closed. A gap is secured between an edge portion of the cover provided for the apparatus body in a state in which the cover is fitted onto the apparatus body to close the apparatus body and an edge portion of the opening of the storage. The gap is a slot for inserting an optical disk in its upright position to the apparatus body.

3 Claims, 9 Drawing Sheets

PRINTING APPARATUS

BACKGROUND OF THE INVENTION

1. Field of the Invention

The present invention relates to a printing apparatus that performs printing on a print target including a data recordable recording medium.

2. Description of the Related Art

There have been conventional printing apparatuses for printing characters e.g. the tile of data, which is recorded on an optical disc (recording medium), on a surface thereof. The optical disc (recording medium) includes CD-R (Compact Disk Recordable), CD-RW(Compact Disk ReWritable), DVD-R (Digital Versatile Disk Recordable). Among such printing apparatus, one is disclosed in Unexamined Japanese Patent Application Publication No. 2003-72155. This printing apparatus comprises a tray that is movable between within and without the apparatus body, with a recording medium being mounted thereon. This tray extends out of the apparatus body, and a recording medium is mounted on the tray. The tray retracts into the apparatus body, and printing is performed on the recording medium by a printing mechanism provided within the apparatus body. This printing mechanism of the printing apparatus performs printing on a predetermined area of the recording medium mounted on the tray, by moving a carriage having a thermal head equipped therewith, on a tray stored in the apparatus body. This printing apparatus requires having a tray on which a recording medium is to be placed and which is movable relative to the apparatus body; a printing mechanism that moves such carriage having a thermal head equipped therewith within the apparatus body; and so forth. Thus, the structure of the apparatus becomes not necessarily simple.

Against this backdrop, the inventor of the present invention has developed an improved printing apparatus for performing printing on a recording medium. This printing apparatus is an improved one of printing mechanisms for tape printing apparatus, one example of which is disclosed in Unexamined Japanese Patent Application No. 2000-225746. This improved apparatus performs printing on a conventional tape-typed label and can perform printing on a recording medium, as well as performing printing on such a tape-typed label. This improved printing apparatus comprises a printing mechanism in which a thermal head and a platen are oriented vertically and placed face to face, in a predetermined position within the body thereof. The printing apparatus can house an ink cartridge holding an ink ribbon, in a cartridge storage provided at a predetermined position of the apparatus body, in order that the ink ribbon is supplied to this printing mechanism. The structure of this printing apparatus is such that the printing mechanism is driven to carry a recording medium set in its upright position together with the ink ribbon, and thermal transfer printing is performed on a label surface of a recording medium.

When the tape-typed label and an ink cartridge holding an ink ribbon is stored in a cartridge storage, this improved printing apparatus performs thermal transfer printing on such a tape-typed label, in the same way as a conventional tape printing apparatus.

On the other hand, the improved printing apparatus performs printing on a recording medium when the recording medium and an ink cartridge holding an ink ribbon are stored in the cartridge storage.

In this case, the body of the printing apparatus is flat-box-shaped, and the height of the apparatus body is smaller than the diameter of a discoid recording medium. Thus, in order that a recording medium can be mounted in its upright position on the apparatus body, conveyed in the upright position and can have printing performed thereon uprighted, a slit-shaped slot into which a recording medium is inserted is formed on a cover provided for the apparatus body, which covers the cartridge storage in an openable and closable manner, and in such a way that the slot is above and along the conveyance path for conveying the recording medium.

In this improved printing apparatus, firstly the cover provided for the apparatus body is opened, the ink cartridge is stored in the cartridge storage, then the cover provided for the apparatus body is closed and after that the uprighted recording medium is inserted through the slot and mounted on a set position in the apparatus body. In the state in which the recording medium is set to the apparatus body, the center part of the upright-positioned recording medium aligns with the slot of the cover, with the lower half of the recording medium being loaded in the apparatus body and the upper half thereof projecting from the cover toward the outside. When a printing operation is started by the printing mechanism, the ink of the ink ribbon is transferred, by the heating of the thermal head, to the label surface of the recording medium, which is conveyed in such a way as to be sandwiched by the thermal head and a platen, via an ink ribbon put on the top surface of the uprighted recording medium.

In the printing apparatus of this type, a slit-shaped slot is formed on the cover provided for the apparatus body, and a recording medium, which is a print target to be subjected to a printing operation, is inserted through the slot in its upright position. However, due to the slit-shaped slot formed on the cover provided for the apparatus body, the strength of the cover provided for the apparatus body weakens. Therefore, a relatively small external force or an impact might break or damage the cover provided for the apparatus body. To avoid this, a possible measure is to provide a reinforcement member on an edge portion of the slot of the cover provided for the apparatus body. However, this measure involves a problem of an increased complexity of the structure of the cover or cost increase in manufacturing.

SUMMARY OF THE INVENTION

The present invention is made in view of the above problem, and it is an object of the present invention to provide such a printing apparatus as solves the above problem, in which a print target to be subjected to a printing operation, such as a recording medium, can be mounted on the apparatus body without necessity of preparation of a slit-shaped slot on the cover provided for the apparatus body and which does not require the reinforcement of the cover, thus enabling low-cost manufacturing of itself.

To achieve the above object, the printing apparatus of the present invention has a conveyance unit that conveys a print target to be subjected to a printing operation; a print unit that performs printing on the print target; an apparatus body that has a conveyance path for conveying the print target, a storage in which an expendable item to be used in printing is stored, and an opening formed on an upper face of the storage; and a cover provided for the apparatus body which covers the opening so that the opening can be opened and closed, and the printing apparatus of the present invention comprises: a slot formed by securing a gap between an edge portion of the cover provided for the apparatus body in a state in which the cover is fitted onto the apparatus body to close the apparatus body and an edge portion of the opening of the storage, so that when the print target is inserted through the gap to the conveyance path, a part of the print target projects to the outside the apparatus body; and a slot cover that is movable to a closed position to cover the slot and an opened position to open the slot.

The printing apparatus of the present invention may further comprise a slot cover movement mechanism that moves together with the movement of the cover provided for the apparatus body to open the opening of the storage and moves the slot cover to the open position from the closed position.

The slot cover movement mechanism may comprise: a pressing member that presses the slot cover towards the open position from the closed position; and an operational chip that, by being inserted into the pressing member, moves the slot cover to the closed position from the open position.

The conveyance unit may convey an ink ribbon, which is the expendable item, together with the print target; the print unit may perform printing on the print target by the ink ribbon; and the slot cover may comprise: an opening movement mechanism that is pushed by the print target being loaded on the apparatus body and moves to the open position from the closed position; an opening that moves to the closed position from the open position when the print target is loaded from such a direction as in parallel with the direction of conveyance of the ink ribbon; and an opening inhibition mechanism that inhibits insertion of the print target into the apparatus body when the print target is inserted from such a direction as in perpendicular to the direction of the conveyance of the ink ribbon.

In the printing apparatus of the present invention, a cushion member may be provided on at least any one of the edge portion of the slot cover and the edge portion of the opening of the storage.

The print target may be a data-recordable recording medium.

In the printing apparatus, the slot through which a print target to be subjected to a printing operation is allowed to be inserted to the conveyance path within the body of the apparatus, not so that a slit-shaped slot is formed on the cover provided for the apparatus body, but so that the gap between an edge of the cover and an edge of the opening of the storage of the apparatus constitute the slot. Accordingly, no reinforcement is required for the cover of the apparatus, and a low-cost manufacturing is realized thereby.

BRIEF DESCRIPTION OF THE DRAWINGS

This object and other objects and advantages of the present invention will become more apparent upon reading of the following detailed description and the accompanying drawings in which.

DETAILED DESCRIPTION OF THE PREFERRED EMBODIMENTS

Figure 1:
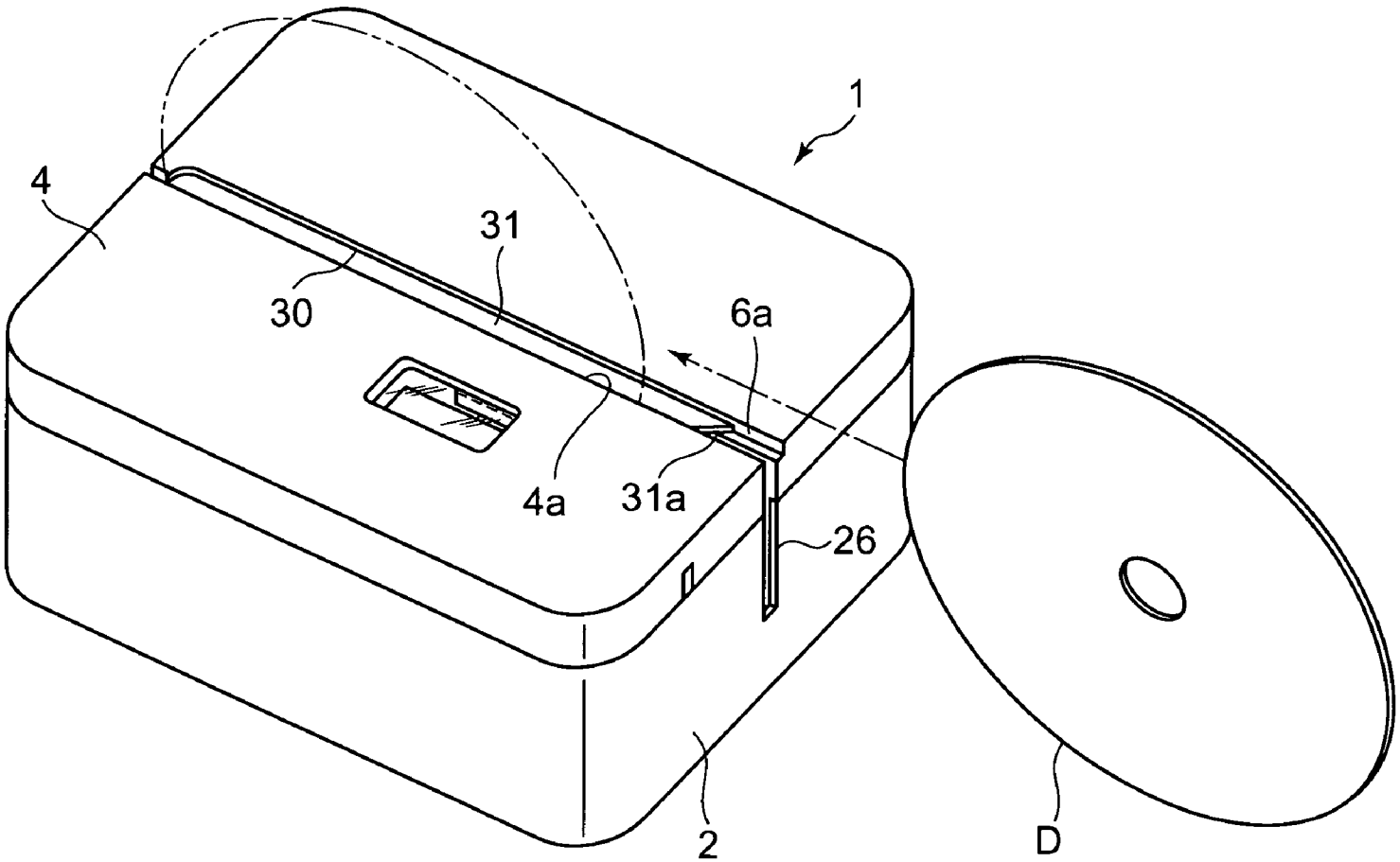
FIG. 1 is a perspective view in which an optical disc is about to be mounted on the printing apparatus according to a first embodiment of the present invention.
Figure 2:
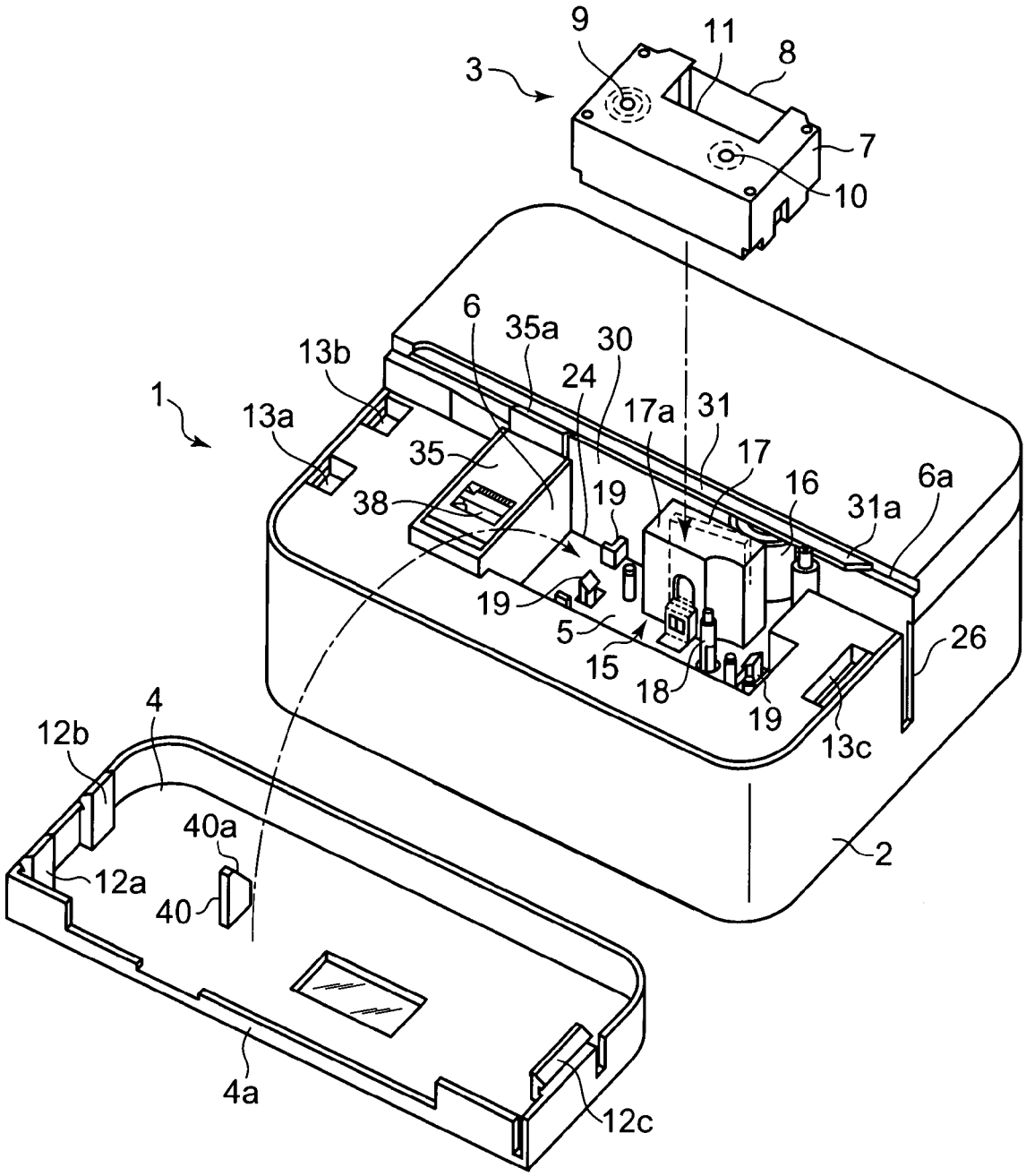
FIG. 2 is a perspective view showing a state in which the cover provided for the apparatus body of the printing apparatus is opened.
Figure 3:
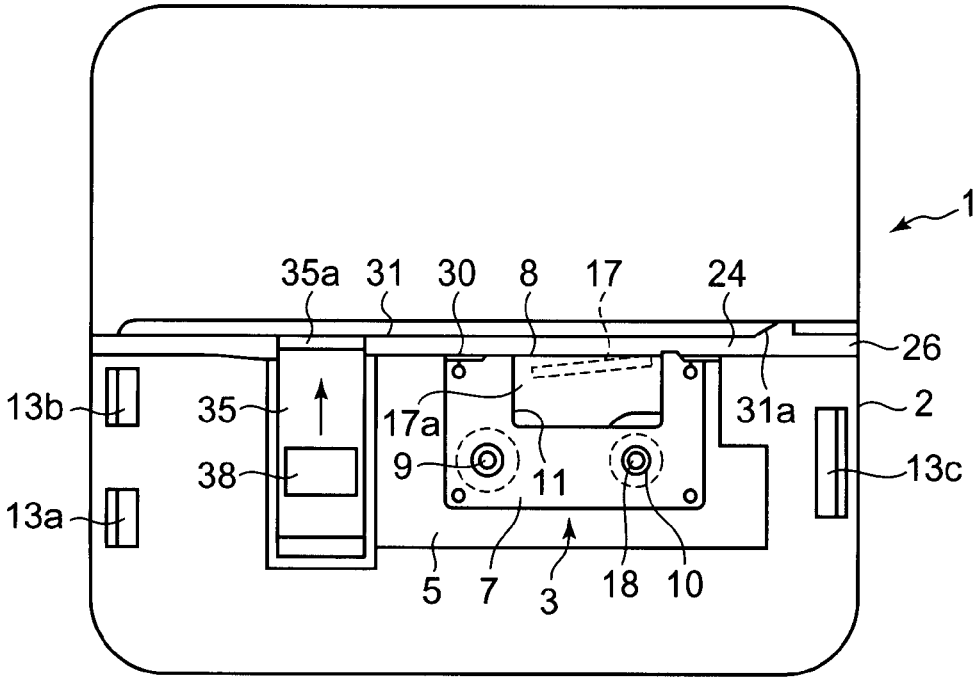
FIG. 3 is a plan view showing a state in which the cover provided for the apparatus body of the printing apparatus is opened.
Figure 4:
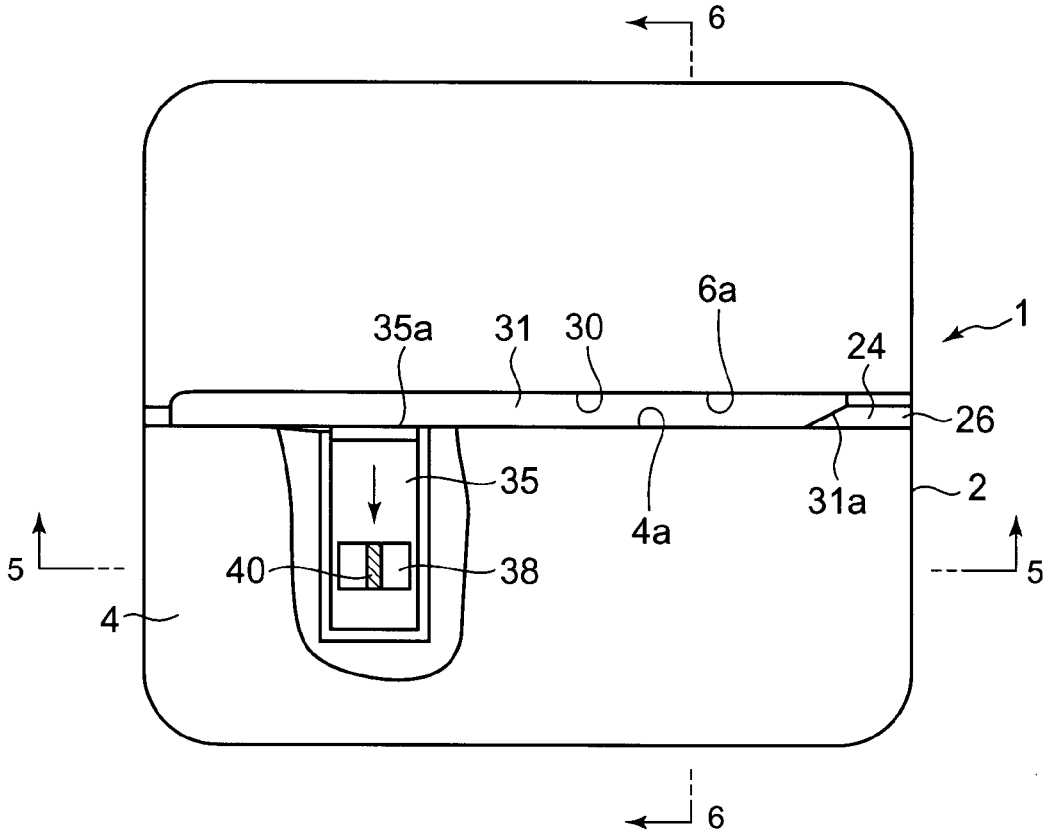
FIG. 4 is a plan view showing a state in which the cover provided for the apparatus body of the printing apparatus is closed.
Figure 5:
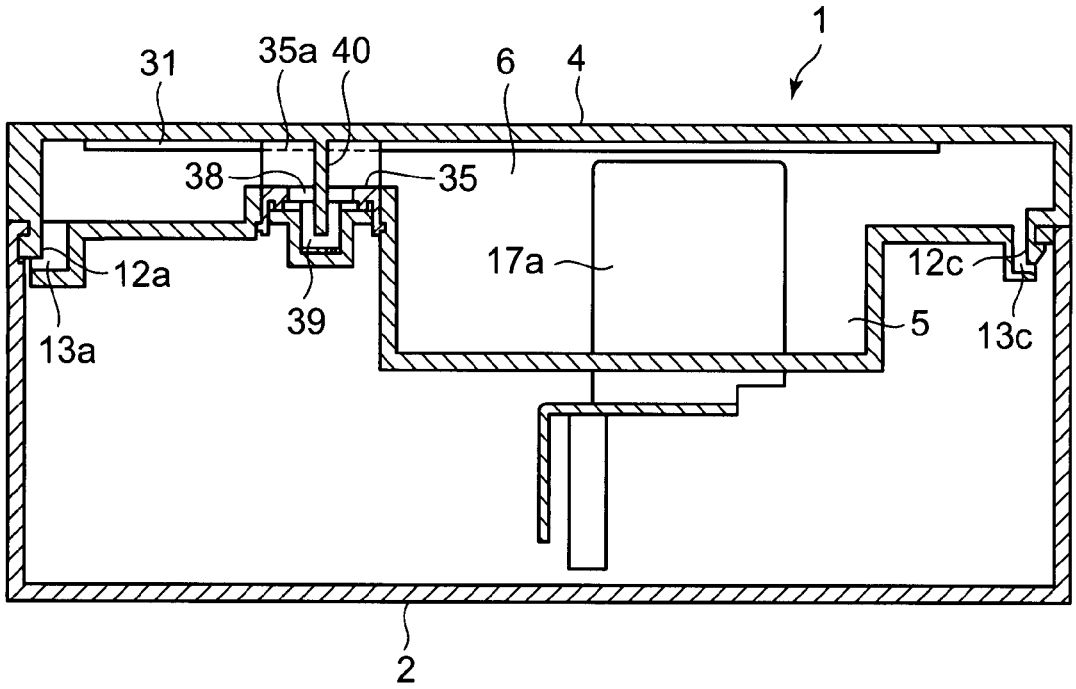
FIG. 5 is a cross-sectional view along line 5-5 in FIG. 4.
Figure 6:
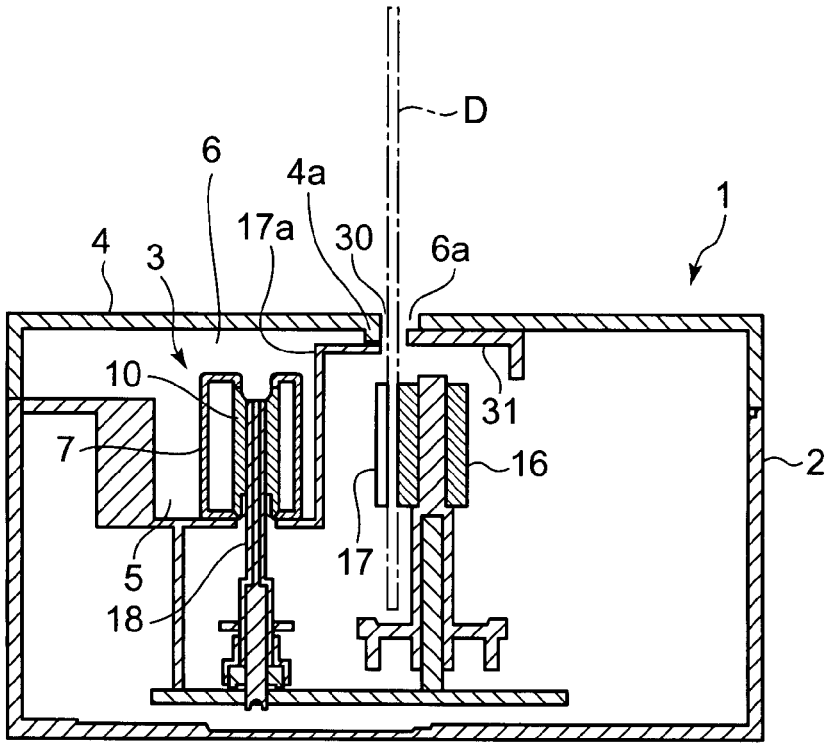
FIG. 6 is a cross-sectional view along line 6-6 of FIG. 4.
Figure 7A:
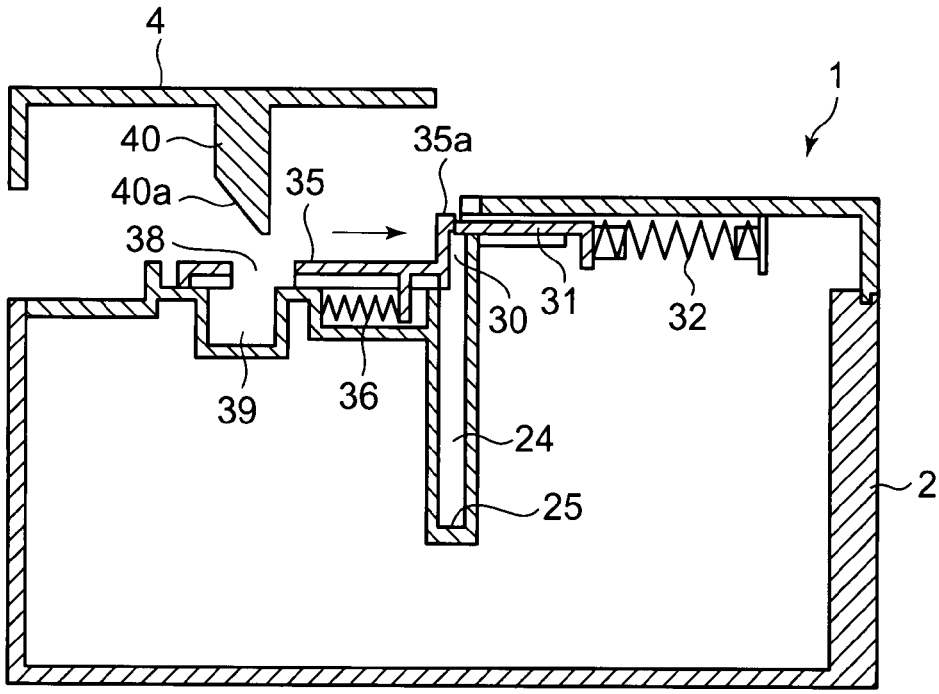
FIG. 7A is a cross-sectional view showing states in which the cover provided for the apparatus body of the printing apparatus is opened and closed.

The embodiments of the present invention are described in the following with reference to the drawings. FIGS. 1 to 7 show a printing apparatus according to a first embodiment of the present invention. FIG. 8 shows an example of a print on an optical disc printed by the printing apparatus. FIG. 1 is a perspective view of the printing apparatus, in which the cover provided for the apparatus body is closed. FIG. 2 is a perspective view of the printing apparatus, in which the cover provided for the apparatus body is opened. FIG. 3 is plan view of the printing apparatus, in which the cover provided for the apparatus body is opened. FIG. 4 is a plan view of the printing apparatus, in which the cover provided for the apparatus body is closed. FIG. 5 is a cross-sectional diagram schematically showing a cross section along line 5-5 in FIG. 4. FIG. 6 is a cross-sectional view schematically showing a cross section along line 6-6 in FIG. 4.

The printing apparatus 1 uses an ink ribbon, which is an expendable item, and prints desired character strings or the like by thermal transferring on a label surface of an optical disc (recording medium), such as a CD-R and a DVD-R, which is to be a print target to be subjected to a printing operation. The printing apparatus 1 according to the embodiments of present invention can perform printing not only on an optical disc, but also on a print target being formed of plastic or paper, etc. and having a plate shape. This printing apparatus 1 comprises an apparatus body 2. In the apparatus body 2, a thermal transfer printing mechanism 15 is provided. A ribbon cartridge 3 holding an ink ribbon is stored in the apparatus body 2.

The apparatus body 2 is of box-shaped contour and a cover 4 of the apparatus body is provided on an upper face of the front side of the apparatus body 2. This cover 4 of the apparatus body is provided detachably to the apparatus body 2. In the apparatus body 2, a storage 5 is formed on the portion to be covered by the cover 4 of the apparatus body. An opening 6 on the upper face of the storage 5 is opened and closed by the attachment and detachment of the cover 4 of the apparatus body.

Inside the one of the right and left edges of the cover 4 of the apparatus body, and inside the other of the edge, a pair of elastically deformable engagement pieces 12*a* and 12*b*, and an elastically deformable engagement piece 12*c* are provided, respectively. On the one of the right and left edges of the upper surface of the front part of the apparatus body 2, engagement holes 13*a* and 13*b* that are associated with the engagement pieces 12*a* and 12*b* are provided, and on the other edge, an engagement hole 13*c* associated with the engagement piece 12*c* is formed. Through the respective insertion of engagement pieces 12*a*, 12*b* and 12*c* to engagement holes 13*a*, 13*b* and 13*c*, the engagement pieces 12*a*, 12*b* and 12*c* elastically deform to be engaged with the edge portions of their respective associated engagement holes 13*a*, 13*b* and 13*c*. This engagement enables attachment of the cover 4 of the apparatus body to the upper portion on the front side of the apparatus body 2. Further, lifting the cover 4 of the apparatus body upwards with more than a predetermined force disengages the engagement pieces 12*a*, 12*b* and 12*c* from the edge portion of the engagement holes 13*a*, 13*b* and 13*c* respectively, allowing the cover 4 of the apparatus body to be removed from the upper part of the apparatus body 2.

The thermal transfer printing mechanism 15 is provided within the storage 5. Then, the ribbon cartridge 3 is stored exchangeably within the storage 5. The ribbon cartridge 3 has a cartridge case 7. In this cartridge case 7, ribbon supply core 9 around which an unused ink ribbon 8 is spooled, and a ribbon take-up core 10 for taking up used portions of ink ribbon 8 are stored. A head insertion section 11 is formed on the cartridge case 7 such that a part of an outer wall of the cartridge case 7 is depressed. Into the head insertion section 11, a thermal head 17 of the thermal transfer printing mechanism 15 is inserted. The ink ribbon 8 is paid out to the head insertion section 11 formed outside the cartridge case 7 from the ribbon supply core 9 that is provided within the cartridge case 7, while the used portion of the ink ribbon 8 being taken up by the ribbon take-up core 10.

The thermal transfer printing mechanism 15 has a platen roller 16 that conveys an optical disc D, which is a print target to be subjected to a printing apparatus, integrally with the ink ribbon 8 such that the ink ribbon 8 paid out from the ribbon cartridge 3 overlies on the optical disc D, in a state in which the ribbon cartridge 3 is stored in the storage 5. Further, the thermal transfer printing mechanism 15 has a thermal head 17 that performs thermal transfer of the ink of the ink ribbon 8 onto the optical disc D and a ribbon take-up shaft 18 that is engaged with the ribbon take-up core 10 of the ribbon cartridge 3 and takes up the ink ribbon 8 consumed by the thermal transfer. The platen roller 16 is provided such that the drive shaft thereof is oriented vertically at a predetermined position of the storage 5. The thermal head 17 is provided in the storage 5 such that a heater element array thereof is vertically arranged and opposed to the platen roller 16 and moved in such a direction as to be away from the platen roller 16 by a drive mechanism that is not shown. The circumference of the thermal head 17, except for the side opposed to the platen roller 16, is covered by a head cover 17*a*. In the storage 5, a plurality of positioners 19 for positioning the ribbon cartridge 3 are provided to a predetermined position with respect to the thermal transfer printing mechanism 15.

In this printing apparatus 1, printing is performed by the thermal transfer printing mechanism 15 having a thermal head 17 and a platen roller 16 that are vertically oriented. Thus, the optical disc D is mounted on the apparatus body 2 in its upright position and conveyed in the upright position. Printing of character string or the like is performed on the uprighted label surface. For realizing such form of printing, a conveyance path 24 for conveying the optical disc D in the upright position is formed so as to extend along the transversal direction of the apparatus body 2, in the edge side of the storage 5 which is along the transversal direction of the apparatus body 2. The bottom surface of the conveyance path 24 constitutes a guide surface 25 that slidably comes in contact with the lower edge of the optical disc D in the upright position to guide the optical disc D. In an intermediate position of the conveyance path 24, the thermal head 17 and the platen roller 16 are provided to be opposed to each other via the conveyance path 24. The end portion in the downstream of the conveyance path 24 constitutes an insertion/ejection outlet 26 into which an optical disc D is inserted before printing and from which the optical disc D is taken out after printing.

In this printing apparatus 1, the effective printing width of the thermal head 17 is smaller than the size of the label surface of the optical disc D, and therefore printing is performed on a part of the label surface. In view of the above fact, in order that the printing area positionally corresponds to the thermal transfer printing mechanism 15, the optical disc D is placed in the upright position, with the substantially lower half thereof being loaded in the apparatus body 2 and with the substantially upper half thereof projecting upward from the apparatus body 2.

In this printing apparatus 1, a slot 30 through which the optical disc D passes is formed between the edge portion 4*a* which is one side edge of the cover 4 provided on the apparatus body 2 and the edge portion 6*a* of the opening 6 of the storage 5 in the apparatus body 2. Thus, a gap is secured between the edge portion 4*a* which is one side edge of the cover 4 and the edge portion 6*a* of the opening 6 of the storage 5 in the apparatus body 2, in a state in which the cover 4 of the apparatus body is closed on the apparatus body, and the cover 4 is structured on the upper portion in the front of the apparatus body 2 so that this gap constitutes the slot 30 extending along the upper space of the conveyance path 24.

A slot cover 31 is provided for the slot 30. This slot cover 31 is provided inside the upper portion of the apparatus body 2 as shown in FIG. 7, and supported slidably so as to project to and retract from the slot 30, with respect to the edge portion 6*a* of the opening 6 of the storage 5, and elastically urged toward the projection direction by a spring 32 serving as an elastic body. This urging force makes the slot cover 31 cover and close the slot 30 right above the conveyance path 24, in an ordinary state in which the optical disc D is not loaded in the apparatus body 2.

On the other hand, on the top surface on the front side, which is adjacent to storage 5, of the apparatus body 2, a pressing member 35 as a slot cover movement mechanism that moves a slot cover 31 is provided so as to be slidable in the forward and rearward directions in the apparatus body 2. This pressing member 35 is plate-shaped and fit slidably into the upper face portion of the apparatus body 2. This pressing member 35 has, in its end, a pressing section 35*a* that extends upward and is located so that the upper end portion of this pressing section 35*a* is provided so as to be opposed to the protruding edge portion of the slot cover 31 and abuts thereto.

Then, this pressing member 35 is elastically urged by a spring 36 acting as an elastic body, in a rearward direction in the apparatus body 2, in other words, in such a direction as to push the slot cover 31 into the retracted position.

In a portion of the pressing member 35, an insertion hole 38 is formed, and on the upper surface of the apparatus body 2, a recess portion 39 that is depressed so as to accommodate to the insertion hole 38. And on the inner surface of the cover 4 of the apparatus body, which opens and closes the storage 5, an operational chip 40 acting as an engagement section that is engageable and disengageable with the insertion hole 38 is integrally provided, and a slant portion 40*a* slanted in one direction is formed on a lower end portion of the operational chip 40.

Figure 7B:
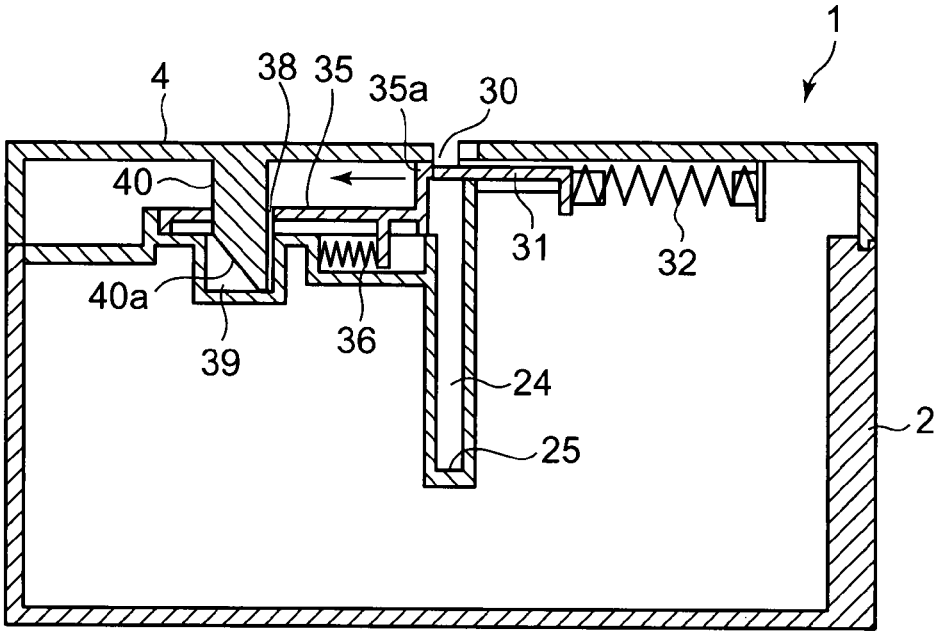
FIG. 7B is a cross-sectional view showing states in which the cover provided for the apparatus body of the printing apparatus is opened and closed.
Figure 8:
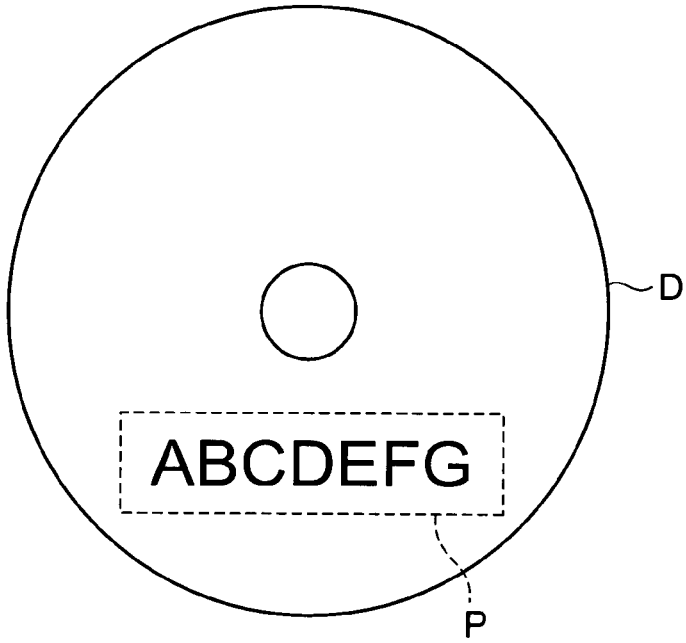
FIG. 8 is a front view showing an example of a print on an optical disc printed by the printing apparatus.

When the cover 4 of the apparatus body is installed to the upper portion of the apparatus body 2, the operational chip 40 is inserted into the insertion hole 38 of the pressing member 35, as shown in FIG. 7B. In this time, the slant portion 40*a* of the operational chip 40 abuts against edge portion of the insertion hole 38, and this abutment moves the pressing member 35 against the force of the spring 36 in a direction of the forward in the apparatus body 2. And, accompanied by this movement, the slot cover 31 projects to a closing position to close the slot 30, from the retracted position by the urging force of the spring 32. In other words, in an ordinary time in which the cover 4 of the apparatus body is attached to the apparatus body 2, the slot 30 is covered by the slot cover 31, and this enables to prevent the incoming of dust particles or the like to the inside of the apparatus body 2 from the slot 30.

Further, as shown in FIG. 7A, when the cover 4 of the apparatus body is removed from the upper part of the apparatus body 2, the operational chip 40 gets out of the insertion hole 38 of the pressing member 35, and in accordance with this, the pressing member 35 is moved by the urging force of the spring 36 in the direction of the backside of the apparatus body 2. This movement retracts the slot cover 31 in the open position in which the slot 30 is opened. That is, the slot cover 31 operates to open and close the slot 30 together with the operation of attachment and detachment of the cover 4 of the apparatus body with respect to the apparatus body 2.

On at least any one of the edge portion of the slot cover 31 which constitutes the edge portion of the slot and the edge portion of the opening of the storage 5, a cushion member (not shown) which is made of a material having a hardness which is lower than that of the optical disc D is provided. This cushion member may be provided so as to be in the both or any one of the edge portion of the slot cover 31 and the edge portion of the opening of the storage 5. The cushion member can be constructed of, specifically, a polymer elastic body containing any one of polyurethane, polyisobutylene and polybutadiene.

This printing apparatus 1 is used so as to be connected communicably to a computer apparatus including a personal computer via a USB cable. When the printing apparatus 1 is used and a predetermined character string is to be printed on the label surface of the optical disc D, firstly, the cover 4 of the apparatus body is removed from the apparatus body 2, then the storage 5 is opened, and a ribbon cartridge 3 is stored in the storage 5. When the cover 4 of the apparatus body is removed from the apparatus body 2 and the opening 6 of the storage 5 is opened, the slot cover 31 moves together with the operation, to the retracted position in the back side of the apparatus body 2, and the space above the conveyance path 24 is opened. Accordingly, a ribbon cartridge 3 can easily and efficiently be inserted into the storage 5, without inhibition of the slot cover 31, when the ribbon cartridge 3 is to be stored into the storage 5.

After that the ribbon cartridge 3 is stored, the cover 4 of the apparatus body is attached to the upper face of the apparatus body 2 and the opening of the storage 5 is closed. When the cover 4 of the apparatus body is attached, the slot cover 31 is moved to the side of the front of the apparatus body 2, together with the attachment operation, and the space above the conveyance path 24, namely the slot 30, is closed.

In this state, the optical disc D in the upright position is inserted into the conveyance path 24 via the insertion/ejection outlet 26 uprighted, and is moved into the upstream side of the conveyance path 24. In this time, the edge portion of the optical disc D abuts against the slant portion 31*a* of the slot cover 31, and this abutment moves the slot cover 31 to a retracted position in the backside portion of the apparatus body 2, against the force of the spring 32. The optical disc D is allowed to the upstream side by this. Then, the optical disc D is placed in a predetermined set position in the upstream side of the conveyance path 24. When the optical disc D is installed to the apparatus body 2, the optical disc D slidably contacts with the edge portion of the slot cover 31 and the edge portion 6*a* of the opening 6 of the storage 5. In this respect, since the edge portion of the slot cover 31 and the edge portion 6*a* of the opening 6 of the storage 5 are provided with a cushion member constructed of a material whose hardness is lower than that of the optical disc D, optical disc D is not damaged.

It is possible to provide an opening movement mechanism in which the slot cover 31 is pushed by the optical disc D and moves to the open position from the closed position when the optical disc D is inserted through the slot cover 31 from the direction that is parallel to the direction in which the ink ribbon is conveyed, into the apparatus body 2, and an opening prevention mechanism which prevents the installation of the optical disc to the apparatus body 2 when the optical disc D is inserted from a direction that is orthogonal to the conveyance direction of the ink ribbon.

The opening movement mechanism can be configured by being provided with a slant portion 31*a* slanted in a predetermined direction at the end portion close to the insertion/ejection outlet 26 of the slot cover 31. When the optical disc D is inserted to the conveyance path 24 of the apparatus body 2 through the insertion/ejection outlet 26, the edge portion of the optical disc D abuts against the slant portion 31*a* and the slot cover 31 is retracted to the retracted position in the apparatus body 2 to open the slot 30. This makes it possible to move the optical disc D to a predetermined set position in the upstream side of the conveyance path 24. In this way, in the printing apparatus 1 it is possible to insert the optical disc D only in the case where the optical disc D is inserted through the insertion/ejection outlet 26 from the direction that is parallel to the direction in which the ink ribbon 8 of the ribbon cartridge 3 is conveyed.

On the other hand, opening prevention mechanism can prevent the insertion of the optical disc D to the apparatus body 2 from a direction that is orthogonal to the direction in which the ink ribbon is conveyed. The opening prevention mechanism can be constituted by the upper surface of the slot cover 31 and a support member that supports the slot cover 31 in the upper direction from the lower direction. When it is tried that the optical disc D is inserted from the above of the apparatus body 2 via the slot 30, the direction of insertion crosses the direction of the conveyance of the ink ribbon 8, and a trouble of the optical disc D's catching of the ink ribbon 8 and damaging it will be caused. However, the slot 30 is closed by the slot cover 31, and it is impossible to insert the optical disc D from the slot 30, and thereby the damaging of the ink ribbon 8 can be prevented.

On the other hand, in a computer apparatus to which the printing apparatus 1 is connected, information to be printed on the optical disc D is input and the starting of printing is instructed. By this instruction, print information is transferred to the printing apparatus 1 from the computer apparatus and print operation is started. In other words, the platen roller 16, the ribbon take-up shaft 18 and the thermal head 17 of the printing mechanism 15 is driven, and the optical disc D and the ink ribbon 8 are conveyed toward the downstream of the conveyance path 24 so as to be overlie each other, and ink of the ink ribbon 8 is thermal-transferred to the label surface of the optical disc D by the thermal head 17 halfway in the conveyance path 24. The optical disc D on which the printing has been performed is conveyed to the insertion/ejection outlet 26. This optical disc D is taken out from the insertion/ejection outlet 26 by a user. FIG. 8 shows an example of print on the optical disc D. As shown in FIG. 8, a character string, "ABCDEF" input from the computer apparatus is printed on a predetermined area P of the label surface of the optical disc D.

When the ribbon cartridge 3 in storage 5 is exhausted and replaced with new one, the cover 4 is taken off from the apparatus body 2, the storage 5 is opened, then the exhausted ribbon cartridge 3 is removed from the storage 5, and a new ribbon cartridge 3 is stored in the storage 5. Also in this exchange, the slot cover 31 is moved to the retracted position in the backside of the apparatus body 2 together with the operation of removing and opening the cover 4 of the apparatus body, and the upper space of the conveyance path 24 is opened. Therefore this exchanging operation is easily and efficiently performed without being inhibited by the slot cover 31.

Accordingly, in the printing apparatus 1 of the present embodiment, the slot 30 through which the optical disc D is inserted is constructed not so that a slit-shaped slot is formed in the cover 4 of the apparatus body, but so that a gap is formed between the edge portion 4*a* of the cover 4 of the apparatus body and the edge portion 6*a* of the opening 6 of the storage 5, to constitute the slot 30. And this slot 30 is opened and closed by a slot cover 31 which opens and closes together with the attachment and detachment of the cover 4 of the apparatus body. Therefore, it becomes possible to prevent the destruction and damaging of the cover 4 of the apparatus body without causing any lack of strength. Further, this structure eliminates necessity of bothersome, costly measure of reinforcing the cover 4 of the apparatus body with a reinforcement member, thus realizing a low-cost manufacturing of itself.

Figure 9:
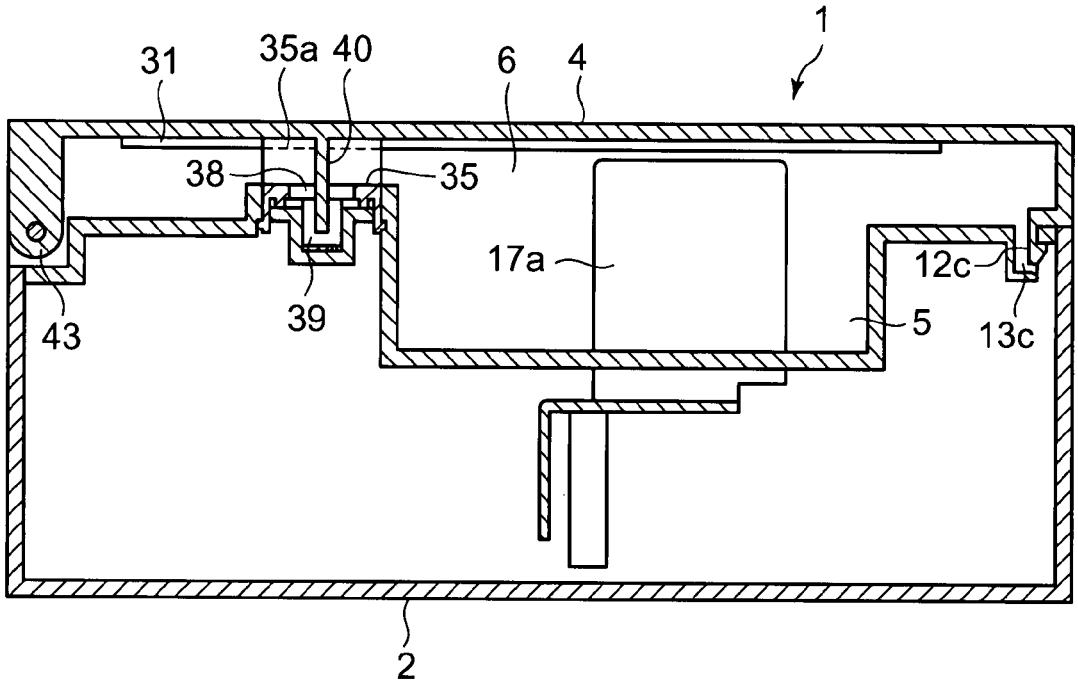
FIG. 9 is a cross-sectional view showing a printing apparatus according to a second embodiment of the present invention.
Figure 10:
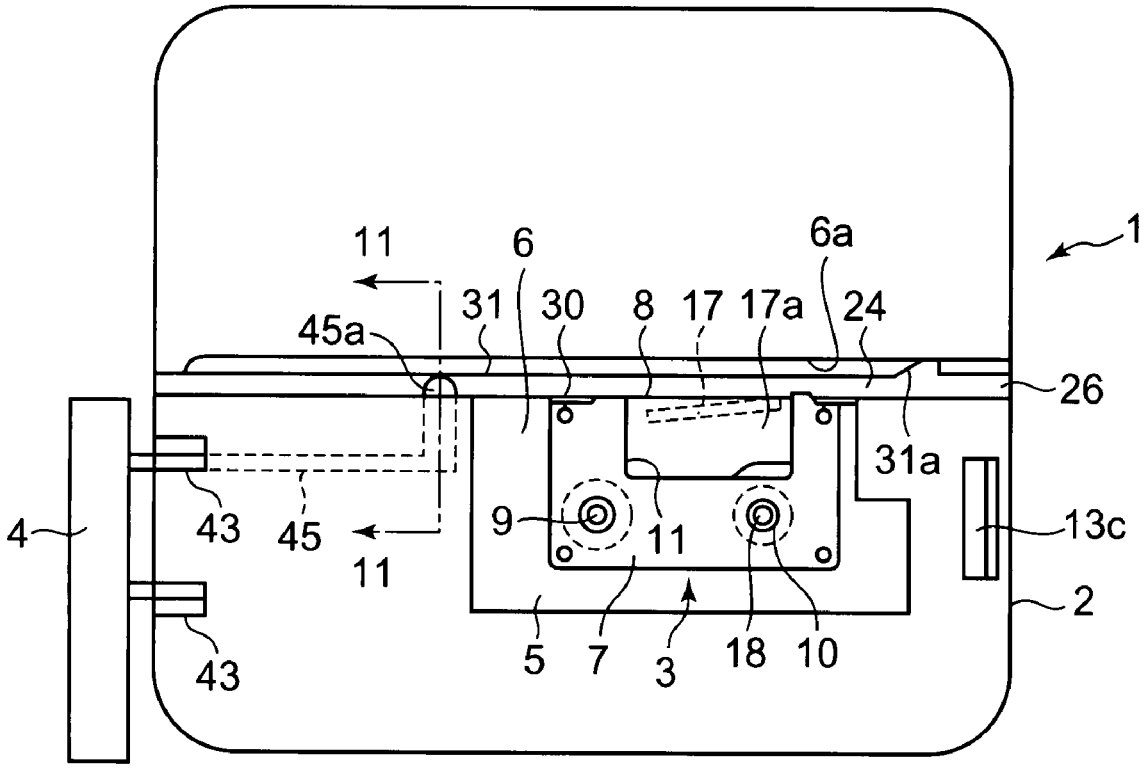
FIG. 10 is a plan view according to a third embodiment of a printing apparatus of the present invention.
Figure 11:
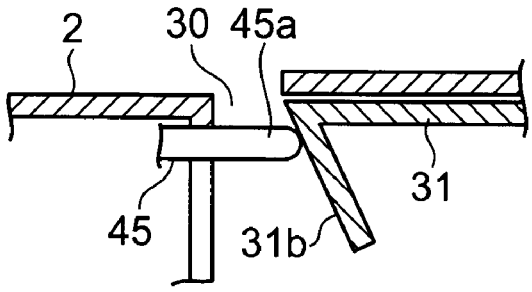
FIG. 11 is a cross-sectional view along line 11-11 in FIG. 10.

In the above-described first embodiment, the cover 4 of the apparatus body is attached to and detached from the apparatus body 2 and the opening of the storage 5 is opened and closed. On the other hand, it is possible to structure the printer such that the edge portion of one end of the cover 4 of the apparatus body is attached to the apparatus body 2 swingably upward and downward via the hinge mechanism 43, so that the swing movement opens and closes the opening of the storage 5, as shown in FIG. 9 as a second embodiment. In this case, the engagement piece 12*c* provided to the other end of the cover 4 of the apparatus body is inserted into the engagement hole 13*c* of the apparatus body 2 and elastically engaged therewith, and thereby the cover 4 is closed and held on the upper surface of the apparatus body 2.

Similarly to the first embodiment, in accordance with the operation of closing the cover 4 of the apparatus body, the operational chip 40 provided to the inner surface of the cover 4, is inserted to the insertion hole 38 of the pressing member 35. This moves the pressing member 35 to the front side of the apparatus body 2, moving the slot cover 31 to a closing position on which the slot 30 is closed. Also, when the cover 4 of the apparatus body is opened, the operational chip 40 is got out of the insertion hole 38 of the pressing member 35 in accordance with the opening movement. With the operational chip 40 gotten out, the pressing member 35 moves to the back side of the apparatus body 2 and the slot cover 31 moves to an opening position to open the slot 30.

FIG. 10 through FIGS. 12A and 12B show a third embodiment. In this embodiment, the cover 4 of the apparatus body is attached to the apparatus body 2 via the hinge mechanism 43 swingably, and swings open and close to thereby open and close the opening of the storage 5. Further, an arm 45 that extends to the inside of the apparatus body 2 is integrally provided to the hinge mechanism 43 of the cover 4 of the apparatus body. At the end portion of the arm 45, a pressing section 45*a* that projects toward the back side of the apparatus body 2 is formed. The end surface of the pressing section 45*a* is of hemi-spherical form, and this end surface of hemi-spherical form is provided so as to face the conveyance path 24 of the apparatus body 2. In the edge portion of that side of the slot cover 31 which faces the conveyance path 24, a receiving section 31*b* that can slidably contact with the end surface of the pressing section 45*a* is formed. This receiving section 31*b* is slanted in the anteroposerior directions with respect to the vertical surface of the apparatus body 2, and slidably contacts with the end surface of the pressing section 45*a* moving from the lower side to the upper side.

Figure 12A:
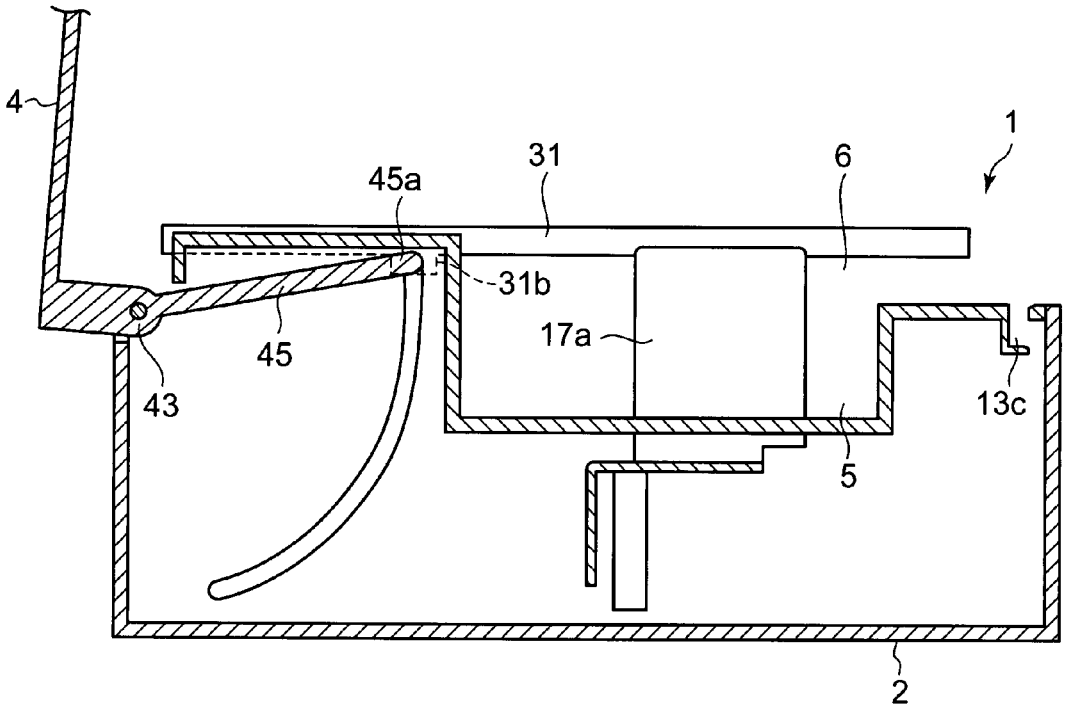
FIG. 12A is a cross-sectional view showing states in which the cover provided for the apparatus body of the printing apparatus is opened and closed.

Then, as shown in FIG. 12A, when the cover 4 of the apparatus body is swung upward and opened, the end surface of the pressing section 45*a* of the arm 45 abuts against the receiving section 31*b* of the slot cover 31. This abutment keeps the slot cover 31 in the retracted position, thereby opening the space above the conveyance path 24, thereby enabling easy, efficient insertion of the ribbon cartridge 3 to the storage 5 without the interference of the slot cover 31.

Figure 12B:
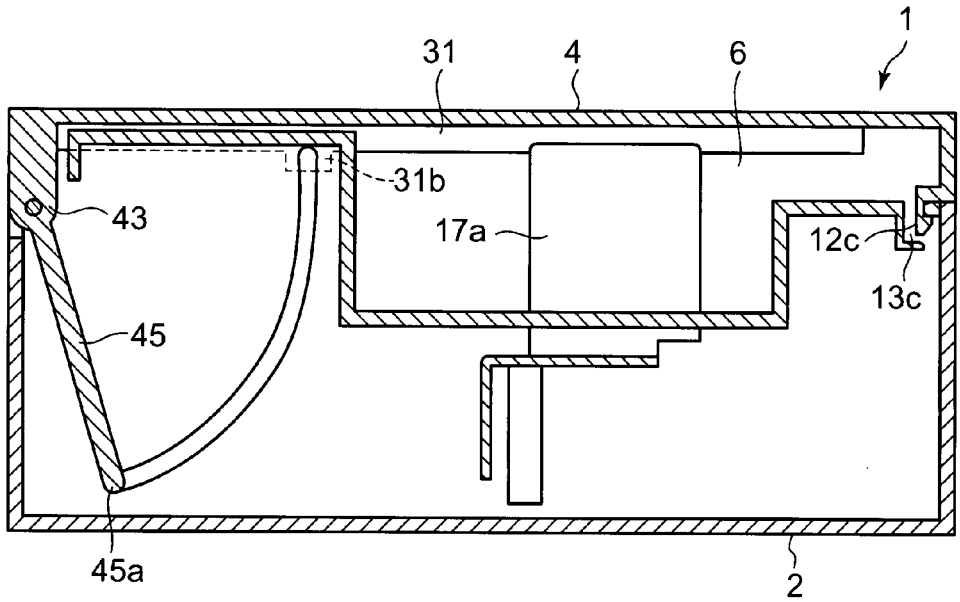
FIG. 12B is a cross-sectional view showing states in which the cover provided for the apparatus body of the printing apparatus is opened and closed.

On the other hand, when the cover 4 of the apparatus body is swung downward and closed, the arm 45 swings around the hinge mechanism 43 integrally with the cover 4 of the apparatus body as shown in FIG. 12B, and the pressing section 45*a* is got out of the receiving section 31*b* of the slot cover 31. By this, the slot cover 31 projects to the front side of the apparatus body 2 to close the slot 30. When the cover 4 of the apparatus body is swung upward and opened, the arm 45 is swung around the hinge mechanism 43 integrally with the cover 4 of the apparatus body, and the end surface of the pressing section 45*a* slidably contacts with the receiving section 31*b* of the slot cover 31. This operation pushes the slot cover 31 into the retracted position in the backside of the apparatus body 2, and the slot 30 is opened.

Figure 13A:
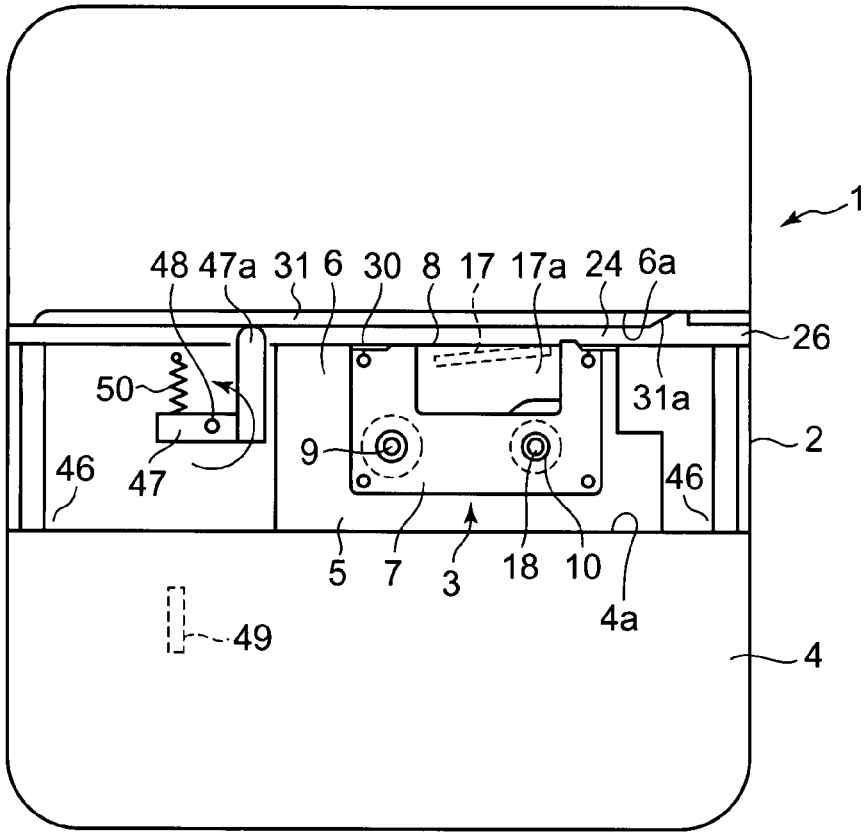
FIG. 13A is a plan view showing states in which the cover provided for the apparatus body of the printing apparatus of the fourth embodiment of the present invention is opened and closed.
Figure 13B:
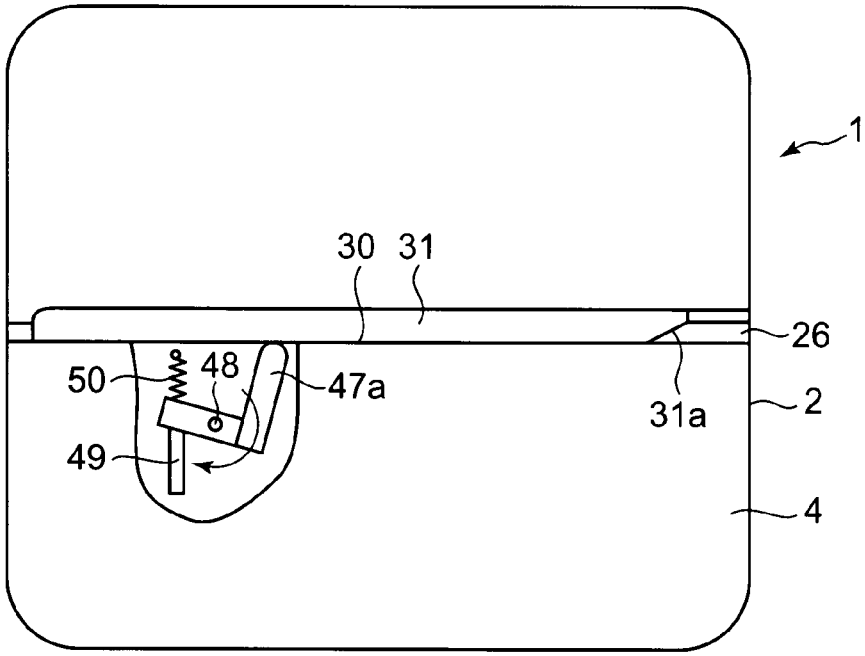
FIG. 13B is a plan view showing states in which the cover provided for the apparatus body of the printing apparatus according to the fourth embodiment of the present invention is opened and closed.

FIGS. 13A and 13B show a fourth embodiment. In this embodiment, the cover 4 of the apparatus body is attached on the upper face of the apparatus body 2 via a slide mechanism 46 in which slide attachment is achieved by the engagement of projecting portions and depressing portions provided on both sides thereof. The slide movement of the cover 4 opens and closes the opening of the storage 5. On the upper face of the apparatus body 2 which is opened and closed by the cover 4 of the apparatus body, a rotation lever 47 is fixed by a pin 48 so as to be rotatable thereabout. And on the inner surface of the cover 4 of the apparatus body, an operational chip 49 that can be abut against the rotation lever 47 is provided integrally.

The rotation lever 47 is elastically urged in the anticlockwise direction in FIG. 13A by the spring 50 acting as an elastic body. This rotation lever 47 has a pushing bar 47*a* extending to the backside of the apparatus body 2. The end surface of this pushing bar 47*a* has a hemi-spherical form. This end surface of hemi-spherical form abuts against an edge portion of the slot cover 31. As shown in FIG. 13A, when the cover 4 of the apparatus body is opened, an urging force of the spring 50 keeps the slot cover 31 in the retracted position, and the upper space above the conveyance path 24 is opened.

Therefore, the ribbon cartridge 3 can easily and efficiently be inserted into the storage 5 without being interrupted by the slot cover 31.

Then, as shown in FIG. 13B, when the cover 4 of the apparatus body is slidden to the backside of the apparatus body 2 and the upper space in the front side of the apparatus body 2, including the opening of the storage 5, is closed, the operational chip 49 abuts against the rotation lever 47. This abutment, opposing the force of spring 50, rotates the rotation lever 47 into the anticlockwise direction in FIG. 13 and the pushing bar 47*a* moves to the front side of the apparatus body 2. In accordance with this movement, the slot cover 31 projects to the front side of the apparatus body 2, and the slot 30 is closed. Further, when the cover 4 of the apparatus body is slidden to the front side of the apparatus body 2 to be opened, the operational chip 49 comes away from the rotation lever 47. Then, the rotation lever 47 is rotated in the anticlockwise direction by the urging force of the spring 50, pushes the slot cover 31 via the pushing bar 47*a* to retract the slot cover 31 and opens the slot 30.

Further, as a fifth embodiment, it is possible to vertically provide a support point around which the cover 4 of the apparatus body can be rotated in half-turn, at the backside corner on the upper face of the apparatus body 2, which is close to the cover 4 of the apparatus body, of the optical disc D insertion/ejection outlet 26.

Then, the cover 4 of the apparatus body is rotated horizontally in half-turn on the upper face of the apparatus body 2 around the support point, and by this half-rotational movement, the opening of the storage 5 is opened and closed. In other words, the cover 4 of the apparatus body is rotated horizontally clockwise in half-turn on the upper face of the apparatus body 2, and thereby the opening of the storage 5 is closed. Also, anticlockwise horizontal rotation in half-turn of the cover 4 on the upper face of the apparatus body 2 opens the opening of the storage 5. Then, in the same way as the fourth embodiment, a rotation lever 47 is attached by a pin 48 so as to be rotatable on the upper surface of the apparatus body 2, as shown in FIG. 13A. Further, an operational chip 49 that can abut against the rotation lever 47 is provided on and integrally with the inner surface of the cover 4 of the apparatus body.

The rotation lever 47 is elastically urged in the anticlockwise direction by the spring 50. This rotation lever 47 has a pushing bar 47*a* extending to the backside of the apparatus body 2. The end surface of this pushing bar 47*a* is of hemispherical form, and this end surface of hemi-spherical form abuts against the edge portion of the slot cover 31. When the cover 4 of the apparatus body is opened, the slot cover 31 is kept in the retracted position by the urging force of the spring 50, and the space above the conveyance path 24 is opened. Then, when the opening of the storage 5 is closed by the horizontal clockwise half-rotation of the cover 4 of the apparatus body, the operational chip 49 abuts against the rotation lever 47. By this abutment, the rotation lever 47, opposing to the urging force of the spring 50, rotates in the clockwise direction in FIG. 13B and moves the pushing bar 47*a* to the front side of the apparatus body 2, and in accordance with the movement, the slot cover 31 projects to the front side of the apparatus body 2 to close the slot 30. Further, when the opening of the storage 5 is opened by the horizontally anticlockwise rotation in half-turn of the cover 4 of the apparatus body, the operational chip 49 comes away from the rotation lever 47.

Then, the urging force of the spring 50 rotates the rotation lever 47 in the anticlockwise direction, and the slot cover 31 is pushed via the pushing bar 47*a* to retract to the open position, opening the slot 30.

In these second to fifth embodiments, similarly to the case of the first embodiment, the slot 30 through which the optical disc D passes is formed not so that the slit-shape slot is formed on the cover 4 of the apparatus body, but so that a gap is formed between the edge portion of the cover 4 of the apparatus body and the edge portion of the opening of the storage 5, to constitute the slot 30, thereby achieving a structure in which the slot 30 is opened and closed by the slot cover 31 moving together with the operation of attachment and detachment of the cover 4 of the apparatus body. Therefore, lack of hardness of the cover 4 of the apparatus body is eliminated, and destruction of and damaging to the cover 4 can be prevented. Further, it becomes possible to manufacture the printing apparatus without bothersome, costly measuring of reinforcing the cover 4 of the apparatus body by use of any reinforcement member, and it becomes possible to realize low-cost manufacturing.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2006-94928 filed on Mar. 30, 2006 and including specification, claims, drawings and summary. The disclosure of the above Japanese Patent Application is incorporated herein by reference in its entirety.

What is claimed is:

1. A printing apparatus comprising:

a conveyance unit that conveys a print target to be subjected to a printing operation;

a print unit that performs printing on the print target;

an apparatus body that includes a conveyance path for conveying the print target, a storage in which an expendable item to be used in printing is stored, and an opening formed in an upper face of the storage; and a cover for the apparatus body which covers the opening so that the opening can be opened and closed;

a slot formed by securing a gap between an edge portion of the cover for the apparatus body in a state in which the cover is fitted onto the apparatus body to close the apparatus body and an edge portion of the opening of the storage, wherein when the print target is inserted through the gap to the conveyance path, a part of the print target projects to the outside the apparatus body;

a slot cover that is movable to a closed position to cover the slot and an open position to open the slot; and a slot cover movement mechanism that moves together with movement of the cover for the apparatus body to open the opening of the storage and moves the slot cover to the open position from the closed position;

wherein the slot cover movement mechanism comprises:

a pressing member that presses the slot cover towards the open position from the closed position; and an operational chip that, by being inserted into the pressing member, moves the slot cover to the closed position from the open position.

2. The printing apparatus according to claim 1, wherein a cushion member is provided on at least one of an edge portion of the slot cover and the edge portion of the opening of the storage.

3. The printing apparatus according to claim 1, wherein the print target is a data-recordable recording medium.

* * * * *